US009429384B2

(12) United States Patent
Whalen

(10) Patent No.: US 9,429,384 B2
(45) Date of Patent: Aug. 30, 2016

(54) ARCHERY RELEASE AID

(71) Applicant: Michael Steven Whalen, Cadillac, MI (US)

(72) Inventor: Michael Steven Whalen, Cadillac, MI (US)

( * ) Notice: Subject to any disclaimer, the term of this patent is extended or adjusted under 35 U.S.C. 154(b) by 0 days.

(21) Appl. No.: 14/607,490

(22) Filed: Jan. 28, 2015

(65) Prior Publication Data

US 2015/0219418 A1 Aug. 6, 2015

Related U.S. Application Data

(60) Provisional application No. 61/934,452, filed on Jan. 31, 2014.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/35.2
See application file for complete search history.

(56) References Cited

U.S. PATENT DOCUMENTS 2,819,707 A * 1/1958 Kayfes ..... F41B 5/1469 124/35.2
D198,166 S * 5/1964 Sorensen ..... F41B 5/1469 124/35.1
3,757,763 A * 9/1973 Pinti ..... F41B 5/1469 124/35.1
3,768,456 A * 10/1973 Hansen ..... F41B 5/1469 124/35.2
4,424,791 A * 1/1984 Muehleisen ..... F41B 5/1469 124/35.2
4,612,907 A * 9/1986 Gantt ..... F41B 5/1469 124/35.2
5,076,251 A * 12/1991 Peck ..... F41B 5/1469 124/35.2
D326,135 S * 5/1992 Mortimer ..... F41B 5/1469 D22/107
5,692,490 A * 12/1997 Walker ..... F41B 5/1469 124/35.2
6,302,093 B1 * 10/2001 Holland ..... F41B 5/1469 124/35.2
6,631,709 B2 * 10/2003 Carter ..... F41B 5/1469 124/35.2
D597,164 S * 7/2009 Jones ..... F41B 5/1469 D22/107
7,581,536 B2 * 9/2009 Porter ..... F41B 5/1469 124/35.2
7,654,254 B1 * 2/2010 Rentz ..... F41B 5/1469 124/35.2
7,926,475 B2 * 4/2011 Jones ..... F41B 5/1469 124/35.2
8,622,051 B2 * 1/2014 Summers ..... F41B 5/1469 124/35.2
8,746,221 B2 * 6/2014 Rentz ..... F41B 5/1469 124/1
2003/0154969 A1 * 8/2003 Carter ..... F41B 5/1469 124/78
2003/0159682 A1 * 8/2003 Pellerite ..... F41G 1/35 124/35.2
2008/0149084 A1 * 6/2008 Whalen ..... F41B 5/1469 124/35.2
2013/0025578 A1 * 1/2013 Jones ..... F41B 5/1469 124/35.2
2015/0090240 A1 * 4/2015 Kelly ..... F41B 5/1469 124/35.2
2015/0090241 A1 * 4/2015 Kelly ..... F41B 5/1469 124/35.2

* cited by examiner

*Primary Examiner* — Alexander Niconovich
(74) *Attorney, Agent, or Firm* — Dunlap Bennett & Ludwig PLLC

(57) ABSTRACT

An archery release aid is provided. The archery release aid includes a body having a circular inner surface forming a finger opening within. A trigger hook protrudes from an outer surface of the body and is configured to releasably hook onto a string of a bow. The present invention further includes a circular sleeve forming a finger opening within. The circular sleeve is suspended within the circular inner surface of the body and is rotatable relative to the circular inner surface.

8 Claims, 4 Drawing Sheets

ARCHERY RELEASE AID

CROSS-REFERENCE TO RELATED APPLICATION

This application claims the benefit of priority of U.S. provisional application No. 61/934,452, filed Jan. 31, 2014, the contents of which are herein incorporated by reference.

BACKGROUND OF THE INVENTION

The present invention relates to an archery release aid and, more particularly, to an archery release aid with a rotatable sleeve.

Archery is the art, practice, or skill of propelling arrows with the use of a bow. Historically, archery has been used for hunting and combat, while in modern times, its main use is that of a competitive sport and recreational activity. A person who participates in archery is typically known as an "archer" or a "bowman", and one who is fond of or an expert at archery can be referred to as a toxophilite.

A release aid is a mechanical device designed to give a crisp and precise loose of arrows from a compound bow. In the most commonly used, the string is released by a finger-operated trigger mechanism, held in the archer's hand or attached to their wrist. In another type, known as a back-tension release, the string is automatically released when drawn to a pre-determined tension.

Existing designs of release aids allow for inconsistent frictional pressure. Inconsistent frictional pressure reduces the accuracy of the arrows point on impact. Further, the existing moving parts of the current release aids wear out or break unexpectedly which results in damage to equipment or individuals As can be seen, there is a need for a release aid for archery that provides consistent frictional pressure.

SUMMARY OF THE INVENTION

In one aspect of the present invention, an archery release aid comprises: a body comprising a circular inner surface forming a finger opening within; a trigger hook protruding from an outer surface of the body and configured to releasably hook onto a string of a bow; and a circular sleeve forming a finger opening within, wherein the circular sleeve is suspended within the circular inner surface of the body, and is rotatable relative to the circular inner surface.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a rotating sleeve used in conjunction with an archery release aid. The combination of design and materials that are machined to coincide with each other assist in creating a consistent smooth non frictional centering pressure pivot point. The rotating sleeve may rotate from 0 to 360 degrees.

The present invention includes a body of sufficient size and shape to conform to an individual's hand. An adjustable hook is used to hook onto the bow string or D-Loop material to assist in the process of drawing a bow. A thumb peg is used to hold onto with the thumb to assist in the process of drawing of a bow. The inner sleeve rotates to create a consistent smooth non frictional centering pressure pivot point. A dowel pin may insert through the main body securing the hook allowing for the adjustment of the hook. The wrist strap slot allows for the use of a wrist strap. An adjustment screw may be used for the adjustment of the hook for the individual's preferences.

Upon drawing a bow and arrow to full draw, the individual allows the release to create the consistent smooth non frictional centering pressure point. Once this is established the individual may continue their shot process until the arrow is fired. Using the technique described above results in a consistent accurate release of the arrow.

Figure 1:
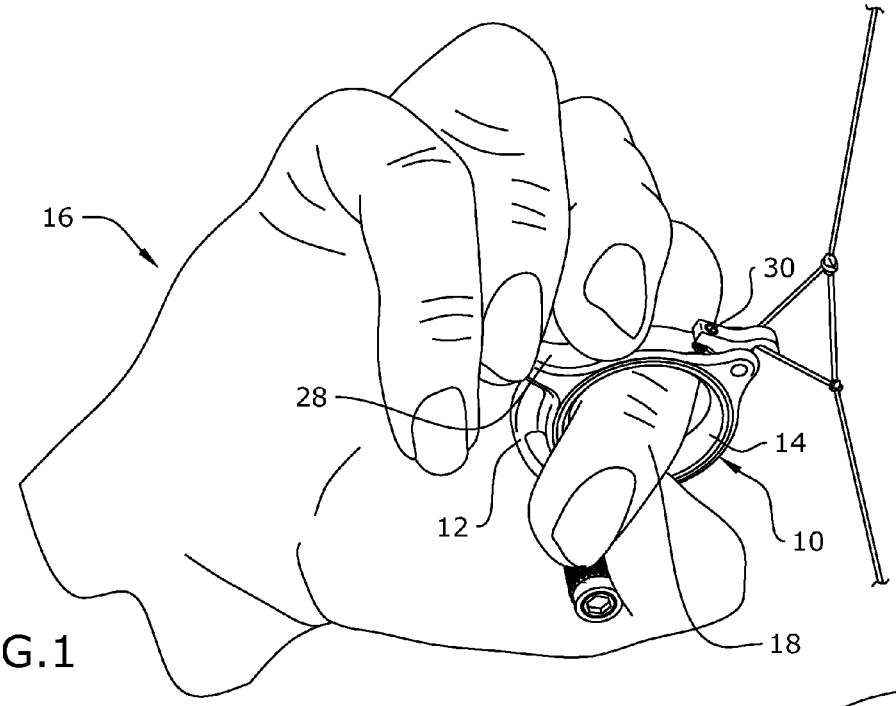
FIG. 1 is a perspective detail view of an embodiment of the present invention shown in use.
Figure 2:
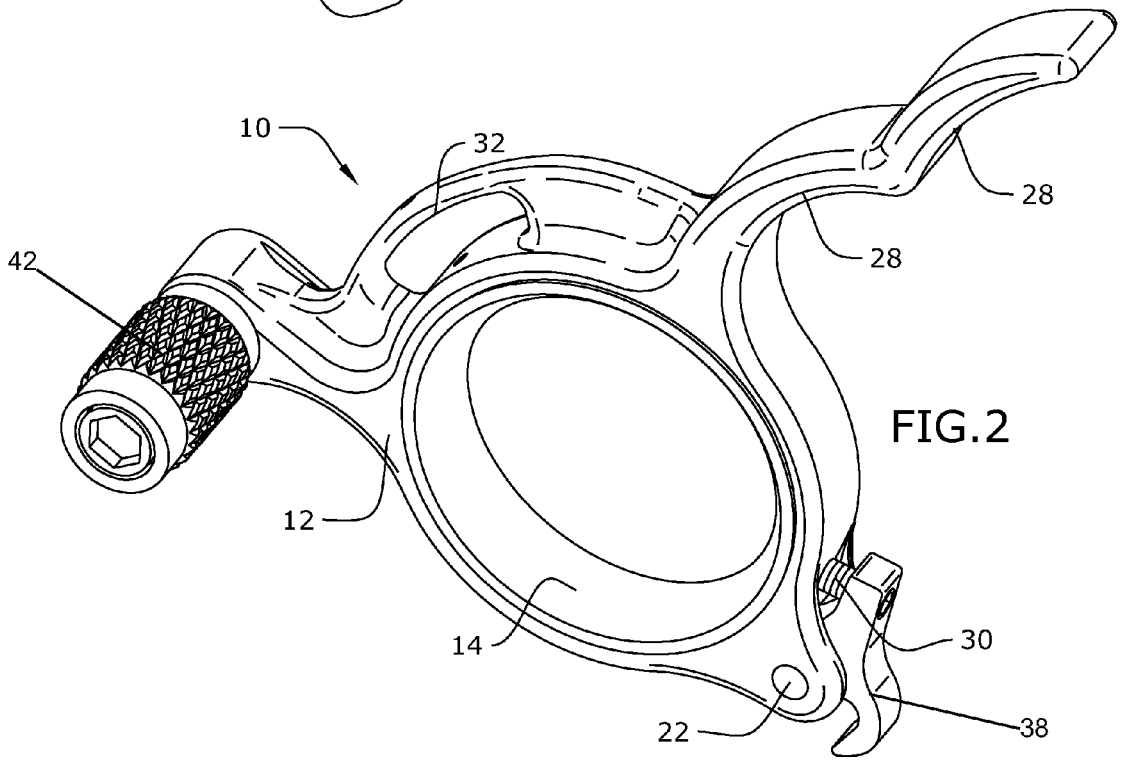
FIG. 2 is a front top perspective view of an embodiment of the present invention.
Figure 3:
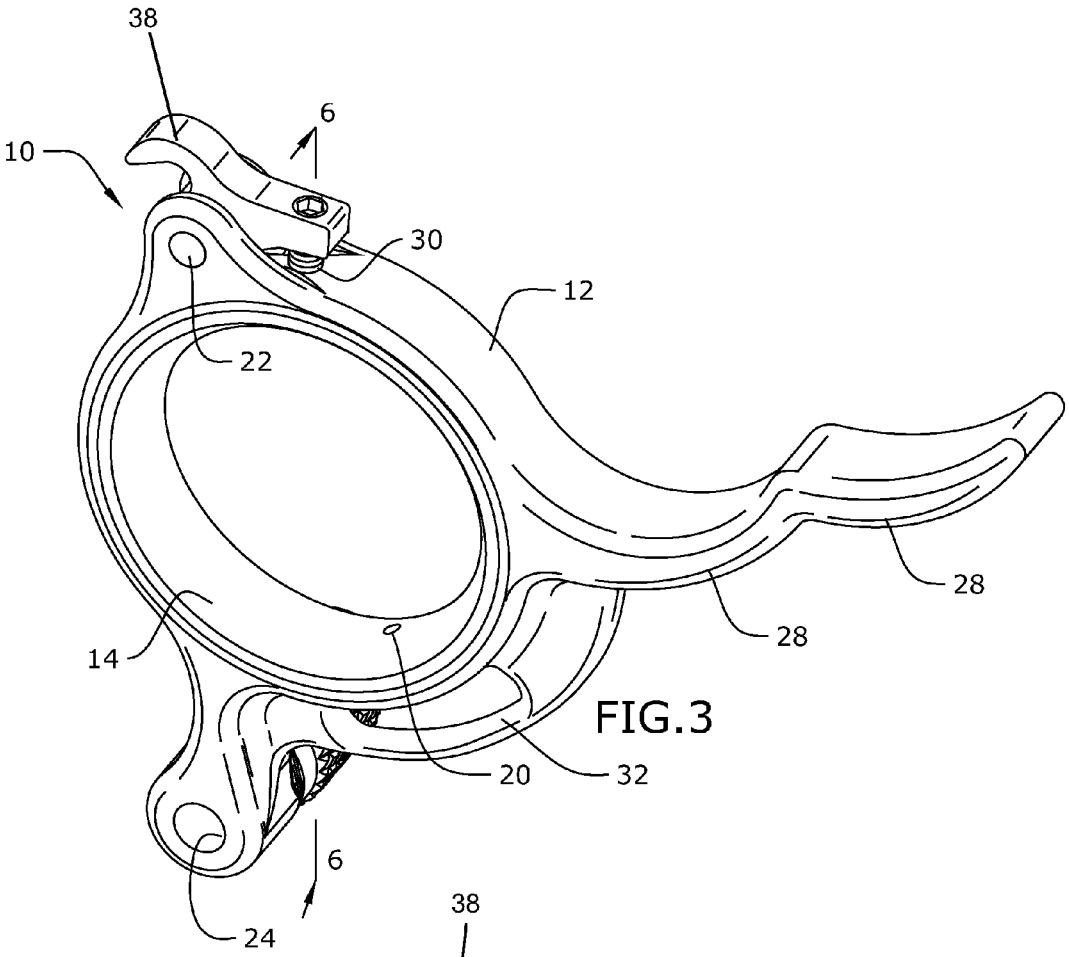
FIG. 3 is a rear bottom perspective view of an embodiment of the present invention.
Figure 4:
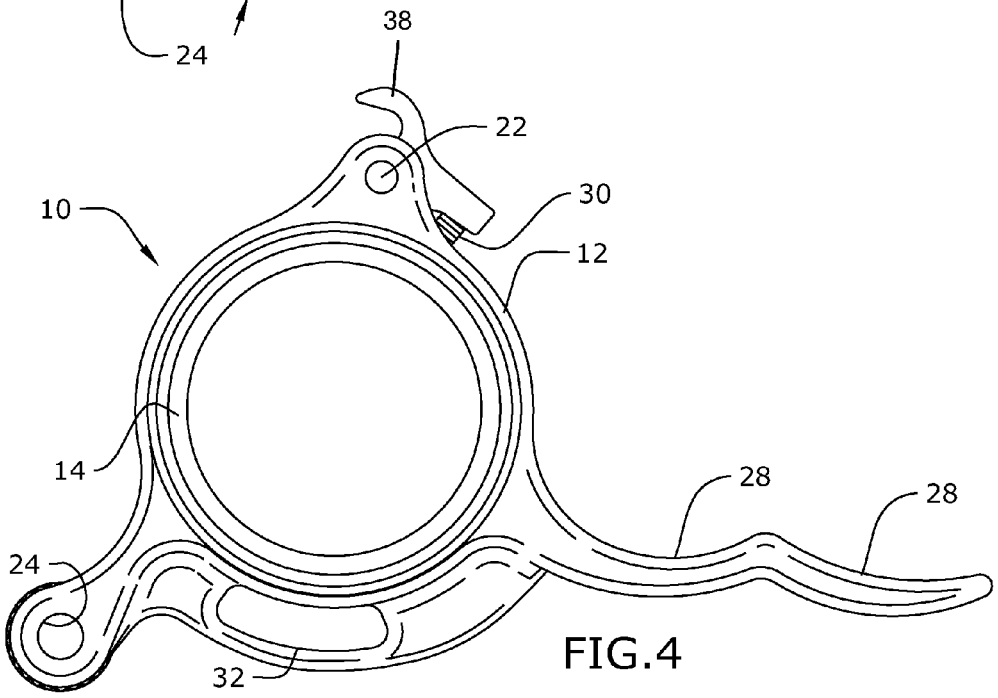
FIG. 4 is a front view of an embodiment of the present invention.
Figure 5:
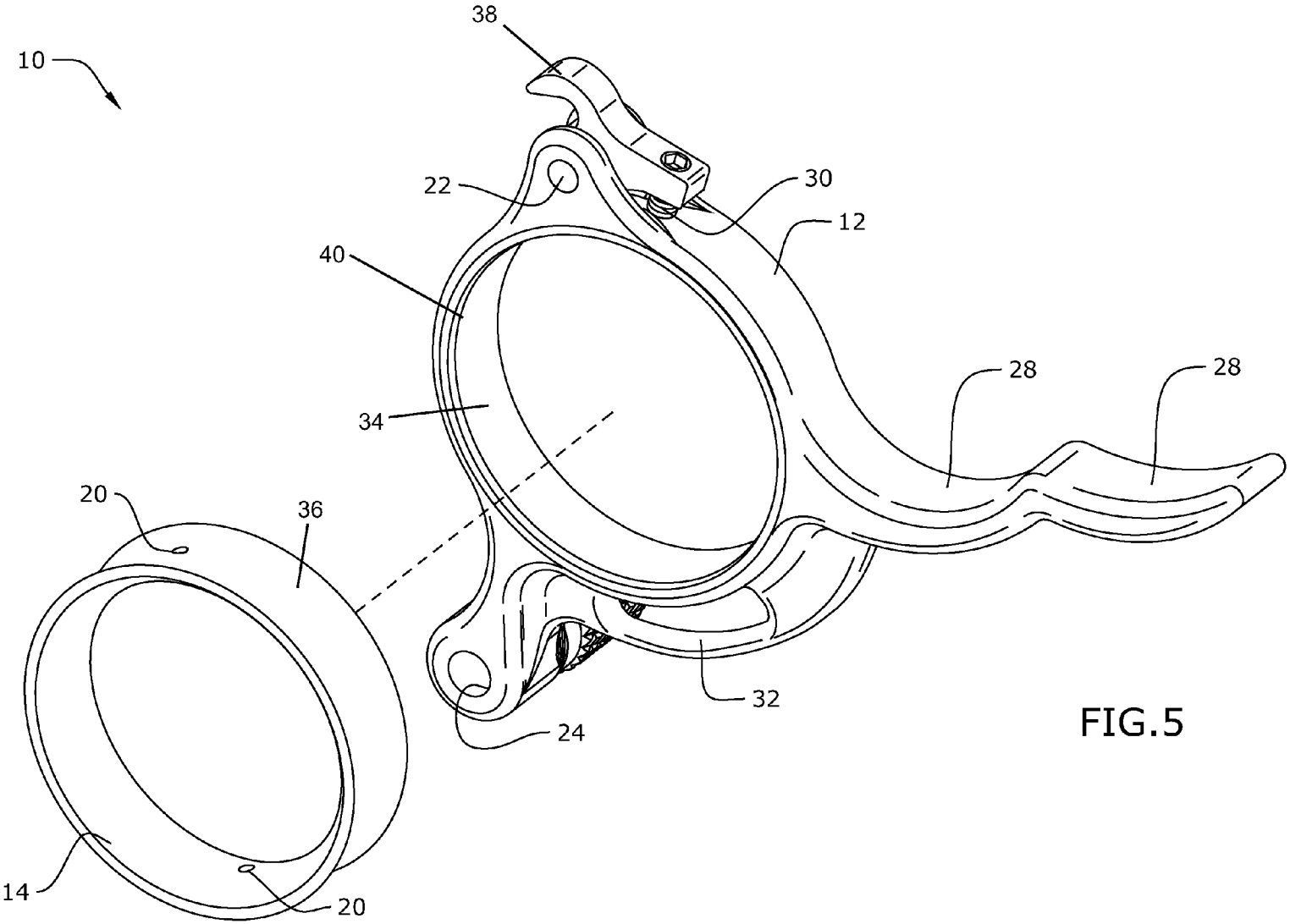
FIG. 5 is an exploded view of an embodiment of the present invention.
Figure 6:
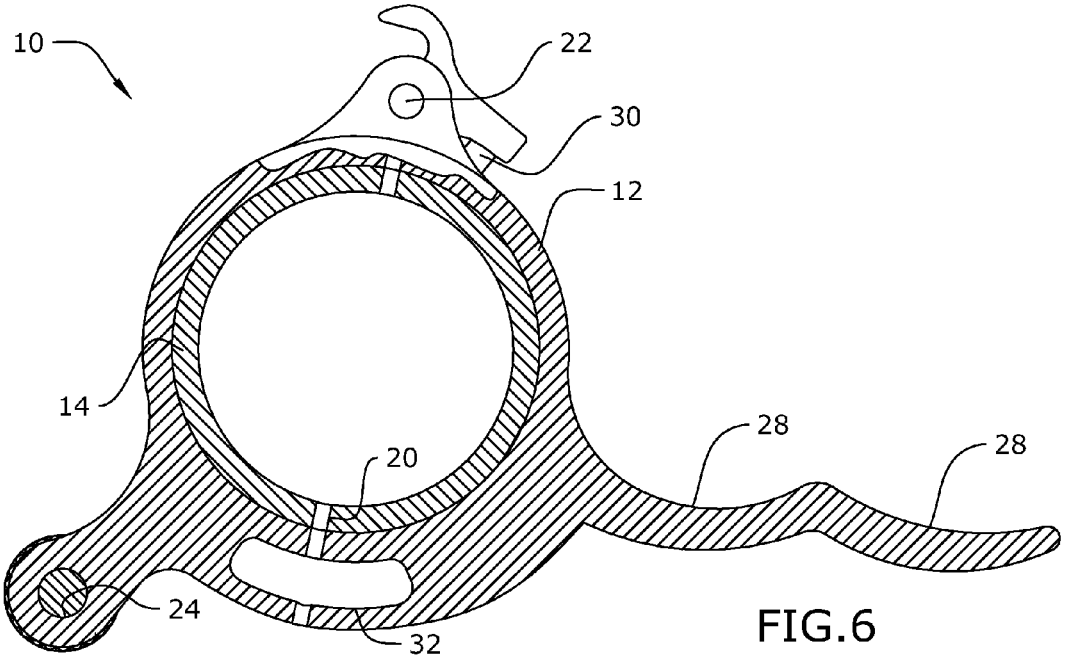
FIG. 6 is a cross-sectional view along line 6-6 of FIG. 5.
Figure 7:
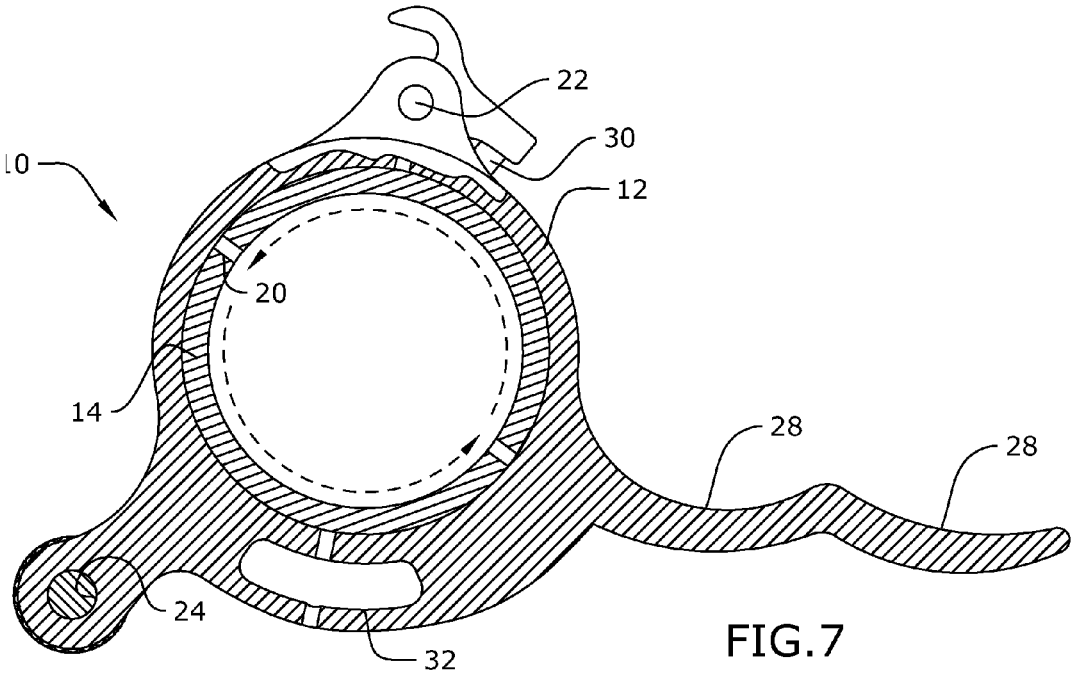
FIG. 7 is a cross-sectional view demonstrating the rotation of the sleeve.

Referring to FIGS. 1 through 7, the present invention includes an archery release aid 10. The archery release aid 10 includes a body 12 having a circular inner surface 34 forming an opening within. A trigger hook 38 protrudes from an outer surface of the body 12 and is configured to releasably hook onto a string of a bow. The trigger hook 38 may be secured to the body 12 by a dowel-pin 22 and may be adjustable by an adjustment screw 30. The present invention further includes a circular sleeve 14 forming an opening sized fit a finger 18 within. The circular sleeve 14 is suspended within the circular inner surface 34 of the body 12 and is rotatable relative to the circular inner surface 34.

In certain embodiments, the circular inner surface 34 and the circular sleeve 14 are continuous. In certain embodiments, the circular sleeve 14 may include a channel formed along a circumference of an outer surface 36 of the sleeve 14. The channel slidably engages with a ridge 40 that is formed along a circumference of the circular inner surface 34. The channel may be formed by a concave outer surface 36 formed along the entire circumference of the outer surface 36 of the sleeve 14.

The archer release aid 10 may include additional components that help with the grip. For example, a finger groove arm 28 may protrude from the outer surface of the body 12. The finger groove arm 28 may include at least one groove, such as two grooves, for receiving fingers. A thumb peg 42 may be protruding from the outer surface of the body 12 as well. The thumb peg 42 may be attached to the body 12 by a screw 24. In certain embodiments, a slot 32 may be formed on the outer surface and sized to receive a wrist strap, securing the archer release aid 10 to the user's wrist 16.

In certain embodiments, the sleeve 14 may include a hole 20 there through, aligning with a hole formed through the body. The aligning holes 20 may provide access for an adjustment tool.

The materials that may be used to make the present invention may include the following: Aluminum, Stainless Steel, Teflon®, leather, Delran®, Brass, Copper, Carbon, Nickel, Steel, Cobalt, Titanium, Magnesium, Iron, Lead, Manganese, Platinum, Silver, Gold, Bronze, or Tungsten. These materials may be used in a singular form or a combination of one or more to form the finished product.

A method of using the present invention may include the following. The individual would draw a bow and arrow back to full draw and anchor point. Once this is established the individual allows the rotation to create the consistent smooth non frictional centering pressure point. When this is established the individual would continue their shot process until the arrow was fired resulting in the consistent arrows point of impact.

It should be understood, of course, that the foregoing relates to exemplary embodiments of the invention and that modifications may be made without departing from the spirit and scope of the invention as set forth in the following claims.

What is claimed is:

1. An archery release aid comprising:

a body comprising a circular inner surface forming one of a ridge and a channel disposed about an inner circumference of the circular inner surface, wherein the circular inner surface comprises an opening in between;

a trigger hook protruding from an outer surface of the body and configured to releasably hook onto a string of a bow; and a circular sleeve forming the other of the ridge and the channel disposed about an outer circumference of an outer surface of the circular sleeve, wherein the circular sleeve comprises a finger opening in between, wherein the ridge makes contact with the channel so that the circular sleeve slidably engages against the body, and is thereby configured to rotate within the opening relative to the circular inner surface about an axis during a draw of the bow, wherein the circular sleeve comprises a first hole running perpendicular to the axis of rotation of the circular sleeve, wherein the first hole aligns with a second hole formed through the body.

2. The archery release aid of claim 1, wherein the circular inner surface is continuous and the circular sleeve is continuous.

3. The archer release aid of claim 1, wherein the circular sleeve comprises the channel and the body comprises the ridge.

4. The archer release aid of claim 3, wherein the channel is formed by a concave outer surface of the circular sleeve.

5. The archer release aid of claim 1, further comprising a finger groove arm protruding from the outer surface of the body and a comprising at least one groove formed to receive at least one finger.

6. The archer release aid of claim 1, further comprising a thumb peg protruding from the outer surface of the body.

7. The archer release aid of claim 1, wherein the body further comprises a slot formed on the outer surface and sized to receive a wrist strap.

8. The archer release aid of claim 1, wherein the trigger hook is secured to the body by a pin and is adjustable by an adjustment screw.

* * * * *